US009806448B2

(12) United States Patent
Yu et al.

(10) Patent No.: US 9,806,448 B2
(45) Date of Patent: Oct. 31, 2017

(54) RIGHT ANGLE TYPE ELECTRICAL CONNECTOR

(71) Applicant: FOXCONN INTERCONNECT TECHNOLOGY LIMITED, Grand Cayman (KY)

(72) Inventors: Kai-Gang Yu, Kunshan (CN); Chun-Ming Yu, Kunshan (CN); Guo-Hua Zhang, Kunshan (CN); Qi-Sheng Zheng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/218,094

(22) Filed: Jul. 25, 2016

(65) Prior Publication Data

US 2017/0025772 A1 Jan. 26, 2017

(30) Foreign Application Priority Data

Jul. 25, 2015 (CN) ..... 2015 2 0543432 U

(51) Int. Cl.
*H01R 12/72* (2011.01)
*H01R 13/405* (2006.01)
(Continued)

(52) U.S. Cl.
CPC ..... *H01R 12/724* (2013.01); *H01R 13/405* (2013.01); *H01R 13/6471* (2013.01); *H01R 13/6587* (2013.01); *H01R 24/60* (2013.01)

(58) Field of Classification Search
CPC H01R 12/724; H01R 13/405; H01R 13/6471; H01R 13/6587
(Continued)

(56) References Cited

U.S. PATENT DOCUMENTS 6,039,583 A * 3/2000 Korsunsky ..... H01R 23/6873 439/101
6,935,870 B2 * 8/2005 Kato ..... H01R 23/688 439/108
(Continued)

FOREIGN PATENT DOCUMENTS

CN 204835065 12/2015
TW M337162 7/2008
TW M434319 7/2012

*Primary Examiner* — Alexander Gilman
(74) *Attorney, Agent, or Firm* — Wei Te Chung; Ming Chieh Chang

(57) ABSTRACT

An electrical connector includes an insulating housing, first terminals, second terminals and a shielding shell. The insulating housing has a base portion and a mating portion, and the base portion has a mounting surface. The first terminals have a pair of differential signal terminals, a power terminal, and a grounding terminal, and the second terminals having the same type of terminals. The power terminal and the grounding terminal are disposed at two opposite sides of the pair of differential signal terminals, respectively. The first terminals and the second terminals have connecting legs extending out of the mounting face. The connecting legs of the power terminals and the grounding terminals are disposed at the middle area of the mounting surface, and the connecting legs of the differential signal terminals are respectively disposed at two opposite sides of the connecting legs of the power terminals and the grounding terminals.

19 Claims, 15 Drawing Sheets

(51) Int. Cl.
*H01R 13/6471* (2011.01)
*H01R 13/6587* (2011.01)
*H01R 24/60* (2011.01)

(58) Field of Classification Search
USPC ..... 439/108, 345, 628
See application file for complete search history.

(56) References Cited

U.S. PATENT DOCUMENTS 7,435,110 B2 * 10/2008 Xiao ..... H01R 12/58 439/107
7,462,071 B1 * 12/2008 Wu ..... H01R 9/032 439/497
8,007,294 B2 * 8/2011 Tanaka ..... H01R 12/712 439/108
8,033,840 B2 * 10/2011 Wang ..... H01R 13/6471 439/108
8,808,029 B2 * 8/2014 Castillo ..... H01R 13/6585 439/607.05
8,932,081 B2 * 1/2015 Kamarauskas ..... H01R 13/41 439/607.35
9,147,975 B2 * 9/2015 Shiratori ..... H01R 12/724
9,276,340 B2 3/2016 Amini et al.
9,356,370 B2 5/2016 Lee et al.
9,472,902 B2 * 10/2016 Kao ..... H01R 13/6471
9,496,653 B2 * 11/2016 Little ..... H01R 13/6582
2011/0237134 A1 * 9/2011 Gao ..... H01R 13/6271 439/660
2012/0015561 A1 * 1/2012 Tsai ..... H01R 24/60 439/660
2013/0330976 A1 * 12/2013 Simmel ..... H01R 13/659 439/660
2014/0073183 A1 * 3/2014 Golko ..... H01R 13/6594 439/607.34
2014/0113493 A1 * 4/2014 Funamura ..... H01R 12/716 439/626
2014/0194005 A1 * 7/2014 Little ..... H01R 13/6585 439/607.28
2014/0220827 A1 * 8/2014 Hsu ..... H01R 12/724 439/629
2015/0171562 A1 * 6/2015 Gao ..... H01R 13/6582 439/345
2015/0340782 A1 * 11/2015 Amini ..... H01R 12/71 439/629
2015/0340783 A1 * 11/2015 Lee ..... H01R 12/71 439/607.29
2015/0380870 A1 * 12/2015 Kao ..... H01R 13/6583 439/607.01
2016/0181722 A1 * 6/2016 Tsai ..... H01R 13/5202 439/587
2016/0268746 A1 * 9/2016 Tsai ..... H01R 12/7052
2016/0352051 A1 * 12/2016 Tsai ..... H01R 13/6585
2016/0352052 A1 * 12/2016 Yu ..... H01R 13/6594
2016/0365655 A1 * 12/2016 Tsai ..... H01R 12/724
2016/0372850 A1 * 12/2016 Tsai ..... H01R 12/724
2017/0018883 A1 * 1/2017 Chen ..... H01R 24/62
2017/0025772 A1 * 1/2017 Yu ..... H01R 12/712
2017/0033507 A1 * 2/2017 Tsai ..... H01R 13/6585

* cited by examiner

RIGHT ANGLE TYPE ELECTRICAL CONNECTOR

BACKGROUND OF THE INVENTION

1. Field of the Invention

The present invention generally relates to an electrical connector, the electrical connector may mate with a complementary connector in two opposite direction.

2. Description of Related Art

USB Type-C association published two different receptacle connectors on Aug. 11, 2014. Each of the two receptacle connectors may mate with a corresponding plug connector in two opposite directions. One of the aforementioned receptacle connectors is mounted on a printed circuit board in a vertical way, and the other one is mounted on a printed circuit board in a lay way. The receptacle connector has a tongue board and two row of terminals retained at two opposite sides thereof. The terminals has a plurality of contacting portions exposed on two opposite sides of tongue board and a plurality of connecting legs extending beyond of the tongue board. Each row of the terminals has a ground terminal, a power terminal, and a pair of signal terminals, disposed therebetween. The connecting legs of the each row of terminals are disposed at a same row, and the dimension of the receptacle connector is large.

A small size electrical connector is desired.

SUMMARY OF THE INVENTION

Accordingly, an object of the present invention is to provide an electrical connector with a small size.

In order to achieve the object set forth, an electrical connector comprises an insulating housing, a plurality of first terminals retained in the insulating housing, a plurality of second terminals retained in the insulating housing, and a shielding shell shielding around the insulating housing. The insulating housing has a base portion and a mating portion extending forwardly from the base portion along a front-to-back direction, and the base portion has a mounting surface. The first terminals have connecting legs extending out of the mounting face. The first terminals have a pair of differential signal terminals, a power terminal, and a grounding terminal. The power terminal and the grounding terminal are disposed at two opposite sides of the pair of differential signal terminals, respectively. The second terminals have connecting legs extending out of the mounting face. The second terminals have a pair of differential signal terminals, a power terminal, and a grounding terminal. The power terminal and the grounding terminal are disposed at two opposite sides of the pair of differential signal terminals, respectively. The connecting legs of the power terminals and the grounding terminals are disposed at the middle area of the mounting surface, and the connecting legs of the differential signal terminals are respectively disposed at two opposite sides of the connecting legs of the power terminals and the grounding terminals.

Other objects, advantages and novel features of the invention will become more apparent from the following detailed description when taken in conjunction with the accompanying drawings.

DETAILED DESCRIPTION OF THE INVENTION

Figure 1:
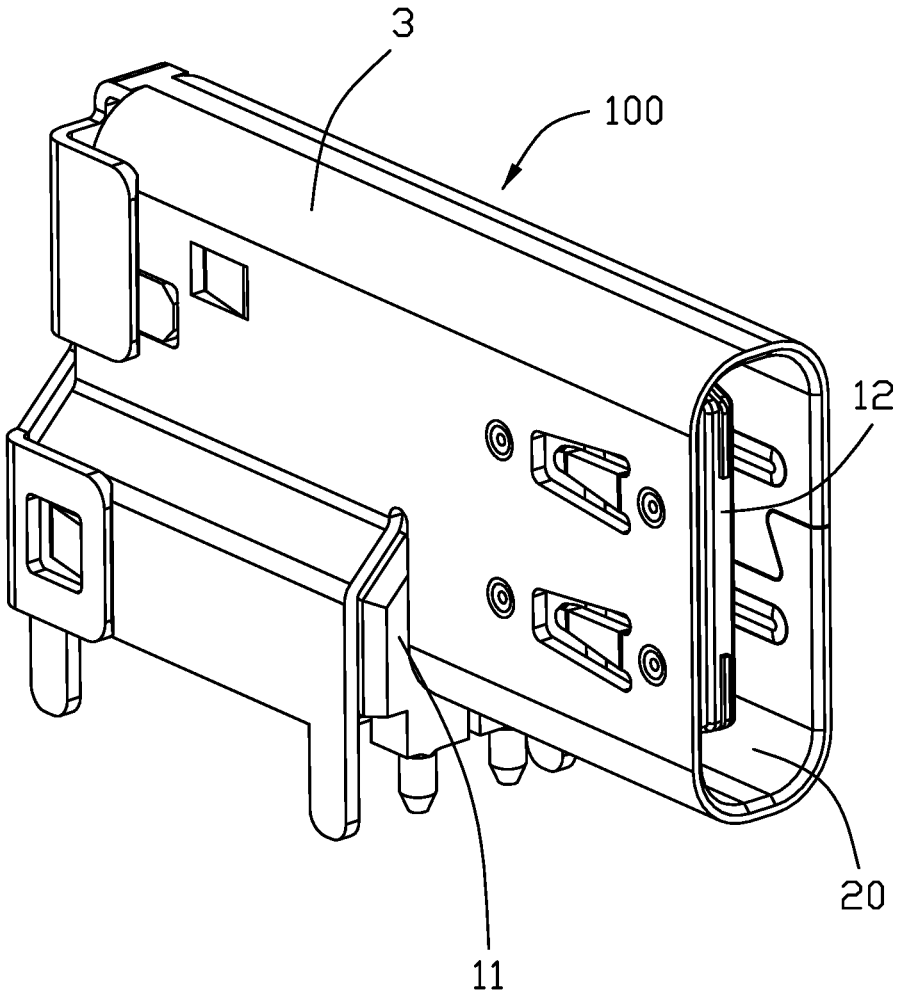
FIG. 1 is a perspective view of an electrical connector of a first embodiment of the present invention.
Figure 2:
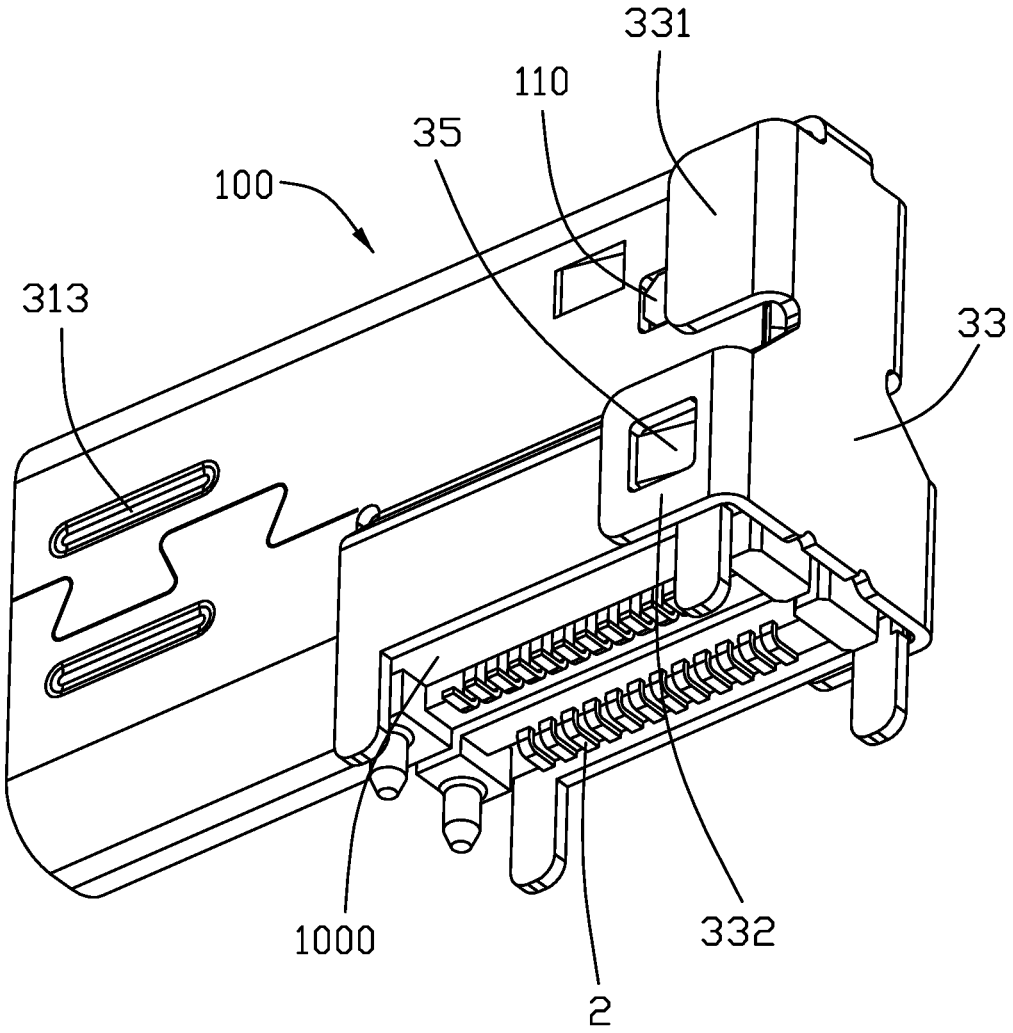
FIG. 2 is another perspective view of the electrical connector shown in FIG. 1.

Reference will now be made in detail to the preferred embodiment of the present invention.

Referring to FIGS. 1 to 15, the present invention is provided with an USB Type-C electrical connector having a mounting face 1000, 2000, 3000, 4000.

Referring to FIGS. 1 to 8, a first embodiment of the electrical connector 100 has a terminal module 10 and a shielding shell 3 shielding therearound. The terminal module 10 has a rear face, a base portion, a mating tongue 12 extending forwardly from the base portion and a mounting face 1000 disposed at a bottom side of the terminal module 10. The terminal module 10 has an insulating housing 1 and a plurality of conductive terminals 2 retained in the insulating housing 1. The conductive terminals 2 are insert-molded in the insulating housing 1. The mating tongue 12 has a stepping portion 120 adjacent to the base portion 11 with a wider size. Define a first direction perpendicular to the front to rear direction and a second direction perpendicular both to the front to rear direction and the first direction. In the first direction, the base portion 11 defines the aforementioned mounting face 1000 at a side. In the second direction, the mating tongue 12 has a first mating face 121 and a second mating face 122 opposite to the first mating face 121. The conductive terminals 2 have contacting portions 201 exposed to the first mating face 121 and the second mating face 122, and the connecting legs 202 extending out of mounting face 1000 along the first direction. The shielding shell 3 surrounding the mating tongue 12 to form a mating cavity 20 opening forwardly. The mating cavity 20 is configured as 180 degree symmetrical so as to mating with a complementary connector in two opposite directions. The mating tongue 12 is perpendicular to the mounting face 1000.

Figure 7:
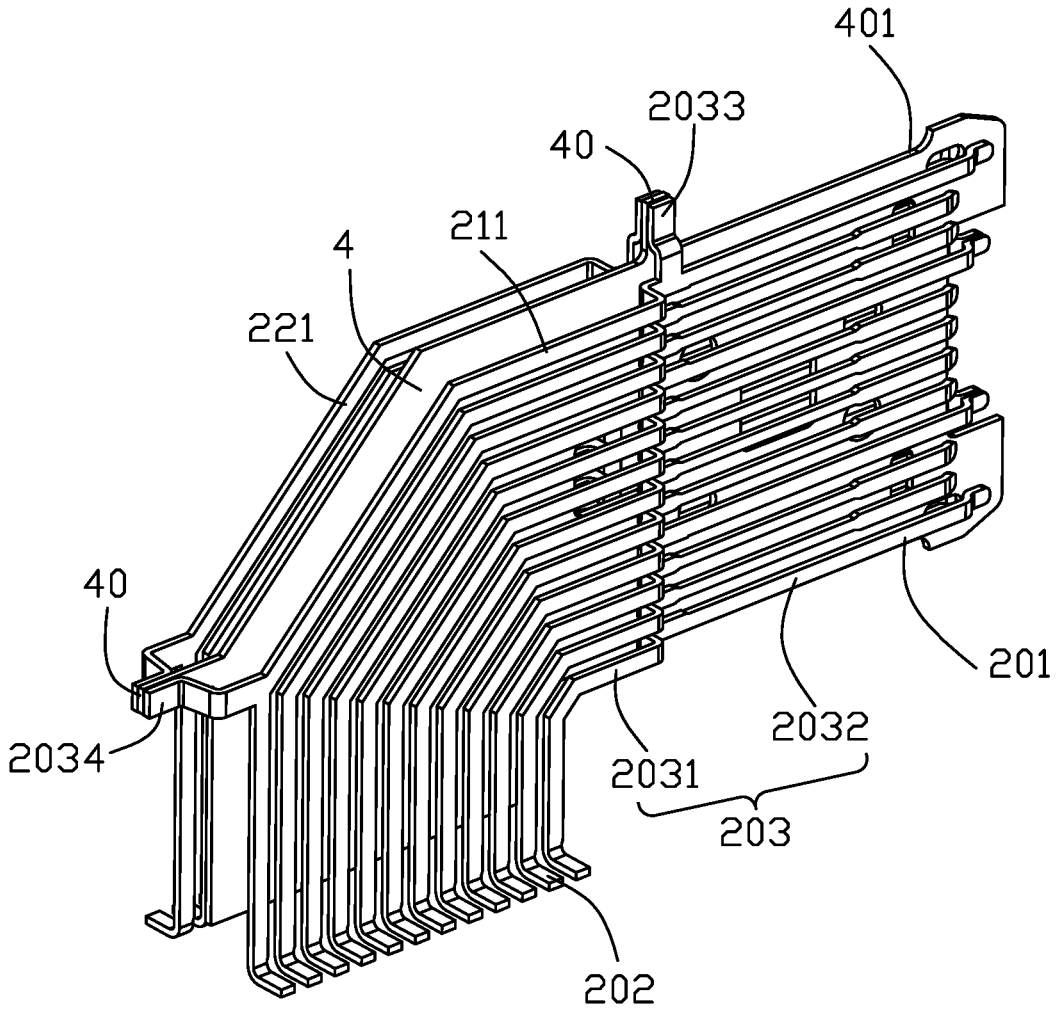
FIG. 7 is a perspective view of first terminals, second terminals and a shielding plate of the electrical connector shown in FIG. 1.
Figure 8:
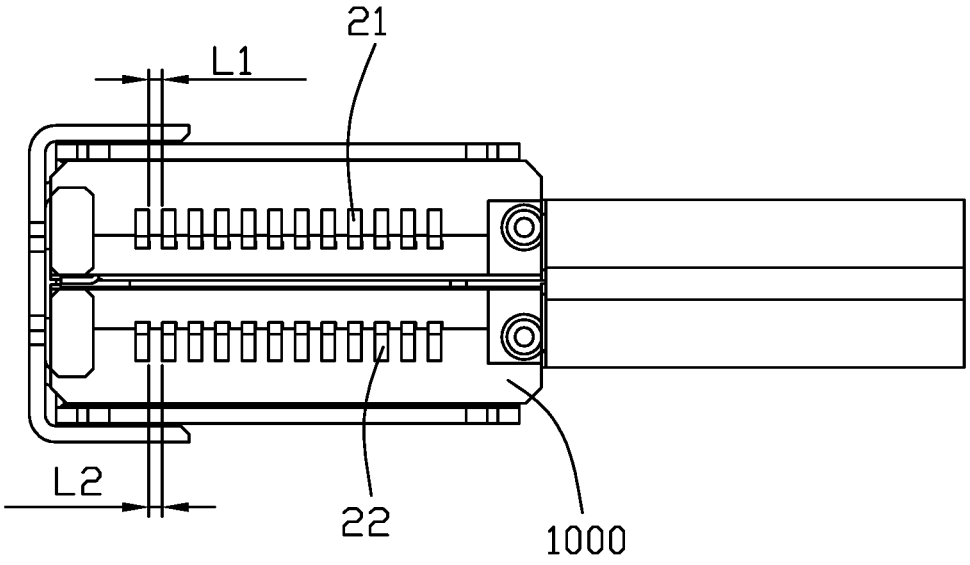
FIG. 8 is a bottom view of the electrical connector shown in FIG. 1.

Referring to FIGS. 7-8, the conductive terminals 2 have a plurality of first terminals 21 and a plurality of second terminals 22. The contacting portions 201 of the first terminals 21 are arranged on the first mating face 121 along the first direction, and the contacting portions 201 of the second terminals 22 are arranged on the second mating face 122 along the first direction. The contacting portions 201 of the first terminals 21 and the second terminals 22 are symmetrical under all rotations about the center of the mating cavity 20. The connecting legs 202 of the first terminals 21 and the second terminals 22 both extend out of the insulating housing 1 along the first direction. The connecting legs 202 of the first terminals 21 are arranged in one row along the front to back direction and mounted on a printed circuit board by surface mounting technology. The front to back direction is also called mating direction. The connecting legs 202 of the second terminals 22 are arranged in a different row relative to the aforementioned row along the front to back direction and mounted on a printed circuit board by surface mounting technology. In the front to back direction, the distance L1 between two adjacent connecting legs 202 of the first terminals 21 is equal, and the distance L2 between two adjacent connecting legs 202 of the second terminals 22 is equal, too. It needs to note that the distance L1 is equal to the distance L2. The electrical connector 100 also has a shielding plate 4 embedded in an interior of the mating tongue 12. The shielding plate 4 is disposed between the row of the first terminals 21 and the row of the second terminals 22 and has two latch portions 401 respectively exposed to two opposite sides of the mating tongue 12. The latch portions 401 are used to latch with corresponding latching members of the complementary connector.

The conductive terminals 2 are roughly configured as L shaped and each has a middle portion 203 connecting with the contacting portion 201 and the connecting leg 202, thereby the contacting portions 201 of the conductive terminals 2 are arranged along the first direction, and the connecting legs 202 of the conductive terminals 2 are arranged along the front to back direction. In this condition, the first terminals 21 has a shortest terminal disposed in the innermost side and a longest terminal disposed in the outermost side. The length of the first terminals 21 is gradually increasing from the shortest terminal to the longest terminal. In fact, the contacting portions 201 of the first terminals 21 have the same length, but the middle portions 203 of the first terminals 21 have different length. The shielding plate 4 is roughly configured as L shaped. Part of the shielding plate 4 is disposed between the contacting portions 201 of the two rows of conductive terminals 21, 22, another part of the shielding plate 4 is disposed between the middle portions 203 of the two rows of conductive terminals 21, 22. The longest terminal of the first terminals 21 is a grounding terminal 211. The head of the grounding terminal 211 contacts with the shielding plate 4. The grounding terminal 211 has a first contacting section 2033 and a second contacting section 2034 both extending outwardly from the middle portion 203 thereof. Part of the middle portion 203 of the first terminal 21 outwardly expands relative to the contacting portion 201 so as to enlarge the distance between the first terminals 21 and the second terminals 22, thereby the middle portion 203 of the first terminal 21 has an expanding portion 2031 outwardly extending and a connecting portion 2032 connecting the expanding portion 2031 to the contacting portion 201 and extending in a same plane with the contacting portion 201. The first contacting section 2033 extends from the connecting portion 2032, and the second contacting section 2034 extends from the expanding portion 2031. The shielding plate 4 has two extending plates 40 respectively contacting with the first contacting section 2033 and the second contacting section 2034. In some embodiments, the first contacting section 2033, the second contacting section 2034 and the two extending plates 40 may all contact with the shielding shell 3. The first contacting section 2033 and the second section 2034 or the two extending plates 40 may all or signally contact with the shielding shell 3. The first and second contacting sections 2033, 2034 and the two extending plates 40 also may not contact with the shielding shell 3. The insulating housing 1 has two receiving slots 13 in which the first and second contacting sections 2033, 2034 and the extending plates 40 received. In the present embodiment, the first contacting section 2033, the second contacting section 2034 and the extending plate 40 all do not contact with the shielding shell 3. The row of the second terminals 22 and the row of the first terminals 21 are mirror symmetrical. The middle portion 203 of the outermost grounding terminal 221 also provided with expanding portion 2031, connecting portion 2032, first contacting section 2033 and second contacting section 2034.

Figure 3:
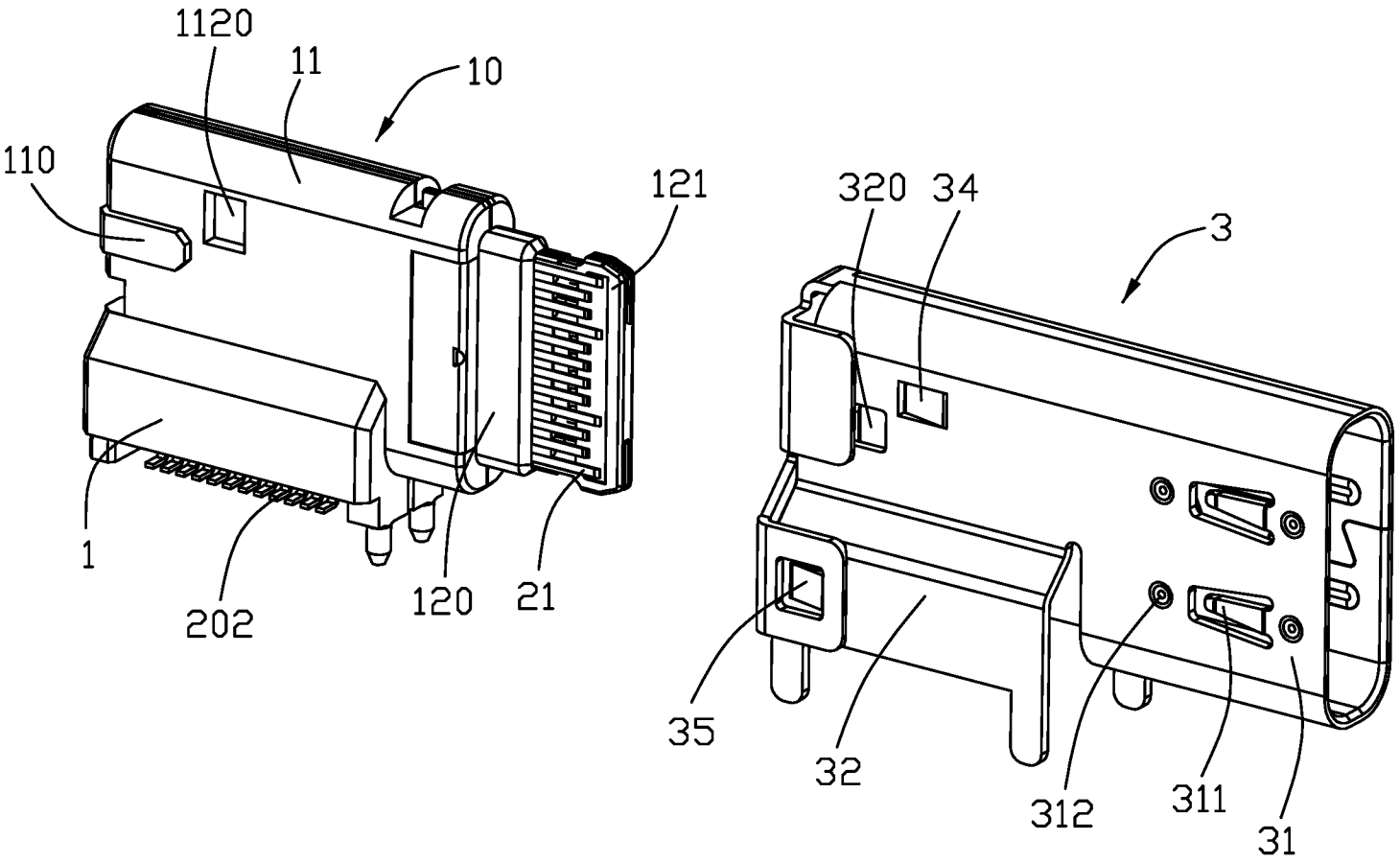
FIG. 3 is a part exploded perspective view of the electrical connector shown in FIG. 1.
Figure 4:
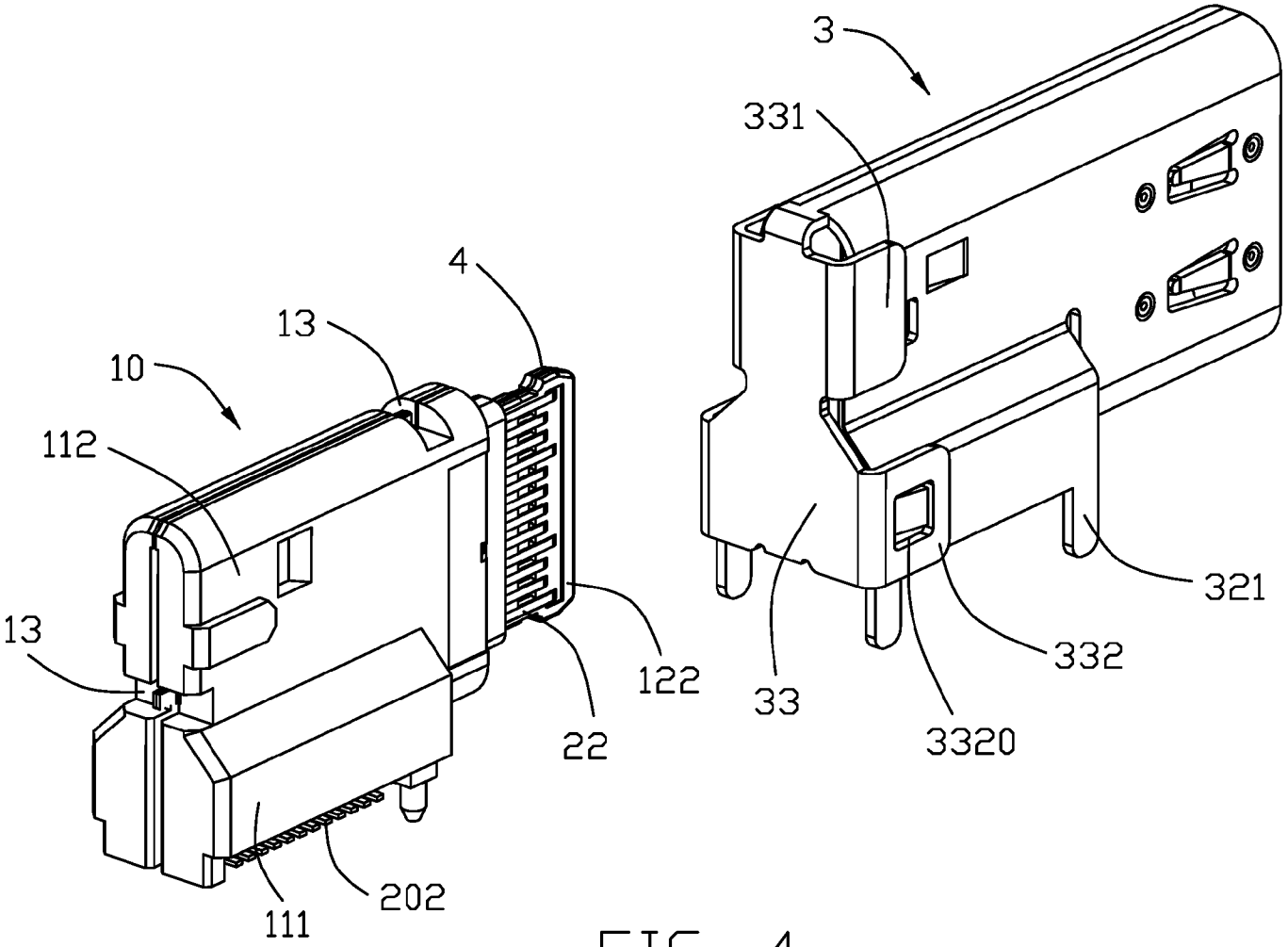
FIG. 4 is another perspective view of the electrical connector shown in FIG. 3.

Referring to FIG. 3 and FIG. 4, the shielding shell 3 has a mating portion 31 surrounding the mating tongue 12 to form a mating cavity 20, a body portion 32 shielding on an exterior of a top portion and two side portions of the base portion 11, and a rear cover 33 shielding behind a rear face of the base portion 11. The mating portion 31 has two opposite long sides and two opposite short sides connecting with the two long sides. One of the two long sides defines a resilient portion 311 extending inwardly and along the front to back direction and two circular convex hulls protruding inwardly and respectively disposed at two side of the resilient portion 311 along the front to back direction. The other long side has a long convex hull 313 protruding inwardly. The rear cover 33 bends from a rear edge of a top portion of the body portion 32. The rear cover 33 entirely shielding the rear face of the insulating housing 1. In the present invention, the base portion 11 having an upper portion 112 and a lower portion 111. The lower portion 112 is wider than the upper portion 111. Part of the body portion 32 corresponding to the lower portion 112 is tore outwardly to shielding on an outer surface of the lower portion 111. The body portion 32 further defines a plurality of soldering legs 321 to be soldered to a printed circuit board (not labeled). A lower edge of the rear cover 33 and a lower edge of the body portion 32 are aligned with each other so as to be arranged in a same plane.

Figure 5:
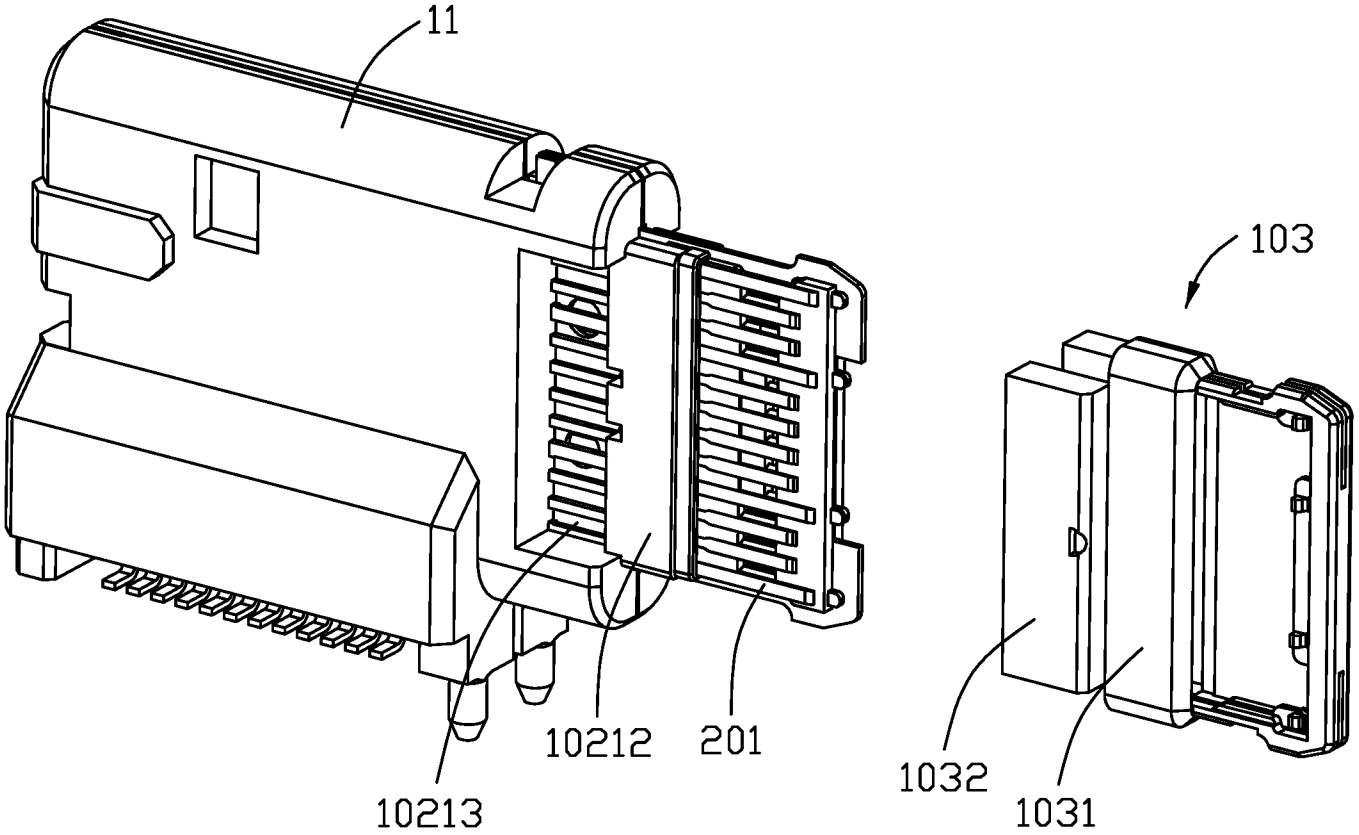
FIG. 5 is a part exploded perspective of a terminal module shown in FIG. 3.
Figure 6:
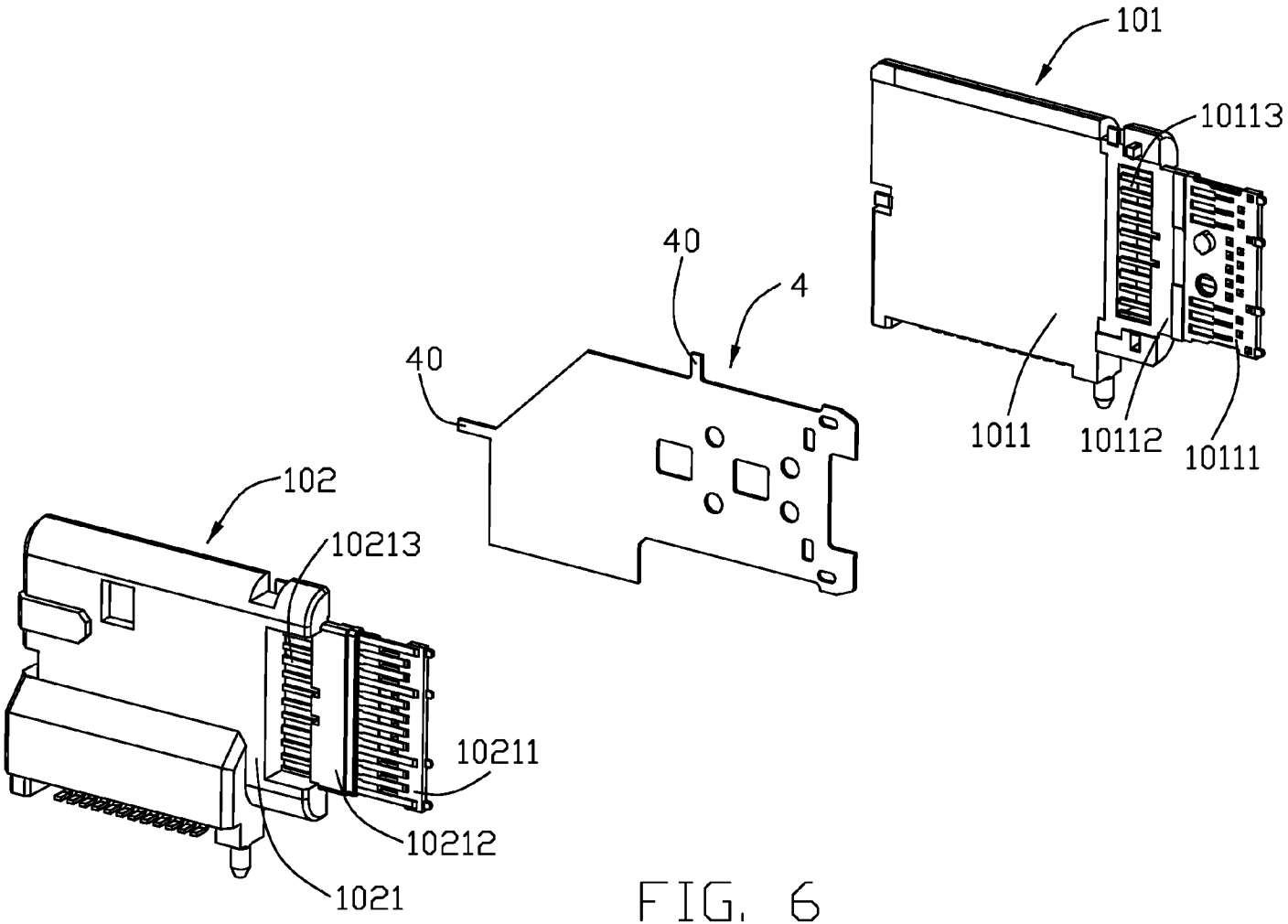
FIG. 6 is an exploded perspective view of the terminal module shown in FIG. 5, wherein the over molded portion is not shown.

Referring to FIG. 5 and FIG. 6, the terminal module 10 has a first terminal module 101, a second terminal module 102, the aforementioned shielding plate 4 sandwiched between the two terminal modules 101, 102 and an over-molding member 103. The first terminal module 101 has a first insulator 1011 and the aforementioned first terminals 21 insert molded with each other. The second terminal module 102 has a second insulator 1021 and the aforementioned second terminals 22 insert molded with each other. The insulating housing 1 comprises the first insulator 1011, the second insulator 1021 and the over-molding member 103. The first insulator 1011 has a first base portion (not labeled) and a first tongue portion 10111 extending forwardly from the first base portion. The second insulator 1021 has a second base portion (not labeled) and a second tongue 10211 portion extending forwardly from the base portion. The contacting portions 201 of the first terminals 21 are exposed to a surface of the first tongue portion 10111, and the contacting portions 201 of the second terminals 22 are exposed to a surface of the second tongue portion 10211. The over-molding member 103 are over-molded at an interior and an exterior of the first tongue portion 10111 and the second tongue portion 10211 to form the complete mating tongue 12. In the present invention, the over-molding member 103 surrounds front sides of the first tongue portion 10111 and the second tongue portion 10211. The two sides and the front side of the shielding plate 4 are all exposed to a surface of the over-molding member 103. The first tongue portion 10111 has a first thickening portion 10112 corresponding to the stepping portion 120. The second tongue portion 10211 has a second thickening portion 10212 corresponding to the stepping portion. The first insulator 1011 has a first hollow portion 10113 formed in the first base portion and adjacent to the first thickening portion 10112, the second insulator 1021 has a second hollow portion 10213 formed in the second base portion and adjacent to the second thickening portion 10212. The first and second hollow portions 10113, 10213 are formed after the moulds being pulled out. The carrier of the first and second terminals 21, 22 are exposed to the two hollow portions 10113, 10213 to exposed to an exterior to be conveniently cropped. The over-molding member 103 also has a coating layer 1031 surrounding the first thickening portion 10112 and the second thickening portion 10212 to form the complete stepping portion 120 and two subsidiary members 1032 respectively accommodated in the first and second hollow portions 10113, 10213 to form a complete base portion 11. The coating layer 1031 entirely surrounds the first thickening portion 10112, the second thickening portion 10212 and two corresponding side edges of the shielding plate 4.

In the assembly process, the terminal module 10 is assembled to the shielding plate 3 along a back-to-front direction, and then bending the rear cover 33 to cover the rear face of the insulating housing 1.

Figure 9:
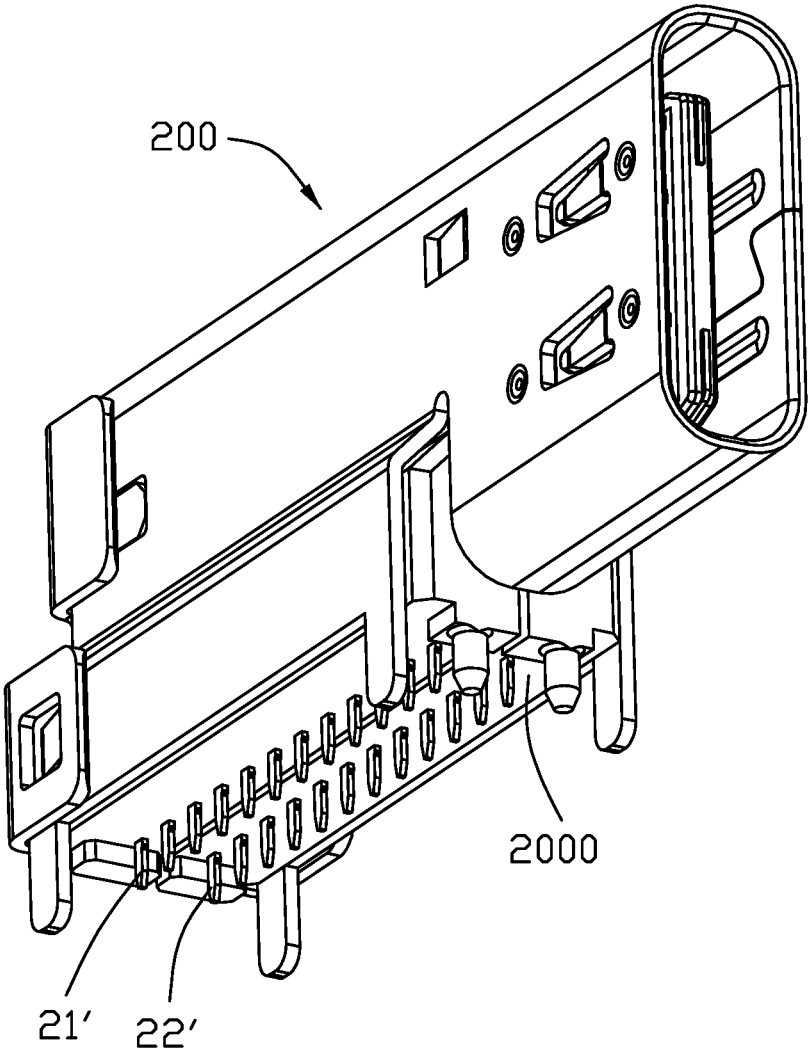
FIG. 9 is a perspective view of an electrical connector of a second embodiment of the present invention.
Figure 10:
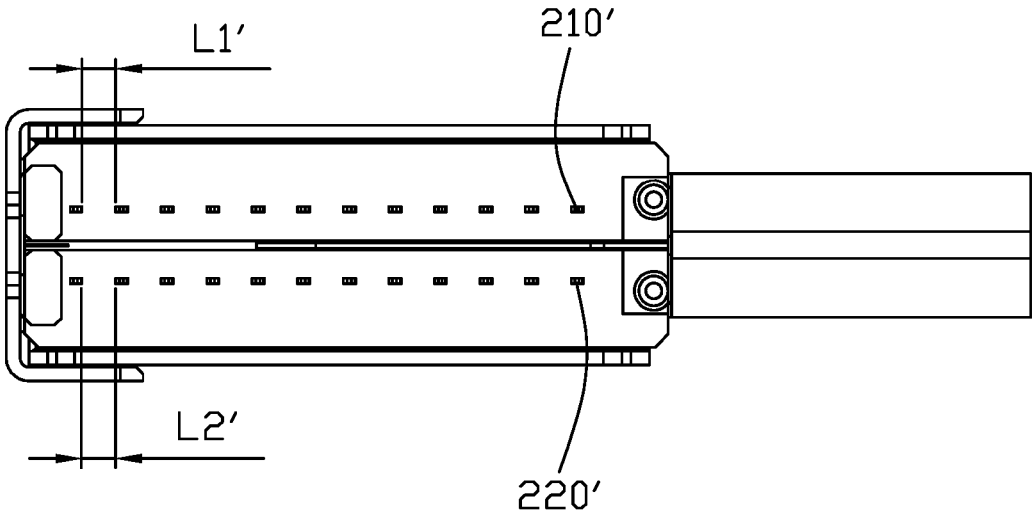
FIG. 10 is a bottom view of the electrical connector shown in FIG. 9.

Referring to FIG. 9 and FIG. 10, an electrical connector 200 of a second embodiment of the present invention is provided. The main structures of the electrical connector 200 are roughly the same as that of the electrical connector 100 of the first embodiment. The same structures will not be described in the present embodiment. The different structures will be described in detail hereinafter.

The connecting legs 210' of the first terminals 21' are arranged in a row along the front to back direction, and the connecting legs 220' of the second terminals 22' are arranged in a different row along the front to back direction. The connecting legs 210', 220' are all configured as through hole type. The distance L1' between two adjacent connecting legs 210' of the first terminals 21 are equal, and the distance L2' between two adjacent connecting legs 220' of the second terminals 22 are equal. It needs to note that the distance L1' and the distance L2' are equal. The distance L1'(L2') in the present embodiment is longer than the distance L1(L2) in the first embodiment.

Figure 11:
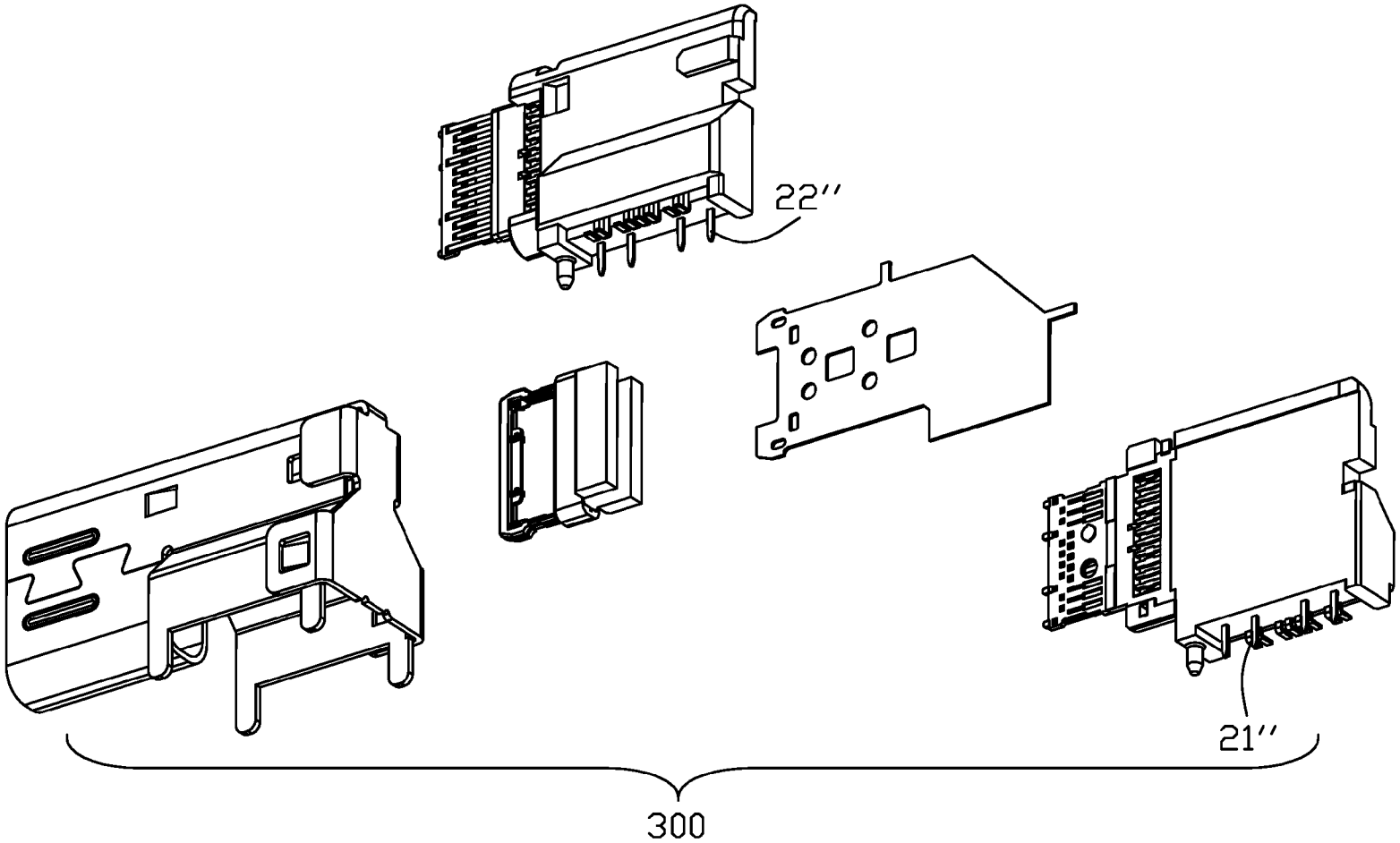
FIG. 11 is an exploded perspective view of an electrical connector of a third embodiment of the present invention.
Figure 12:
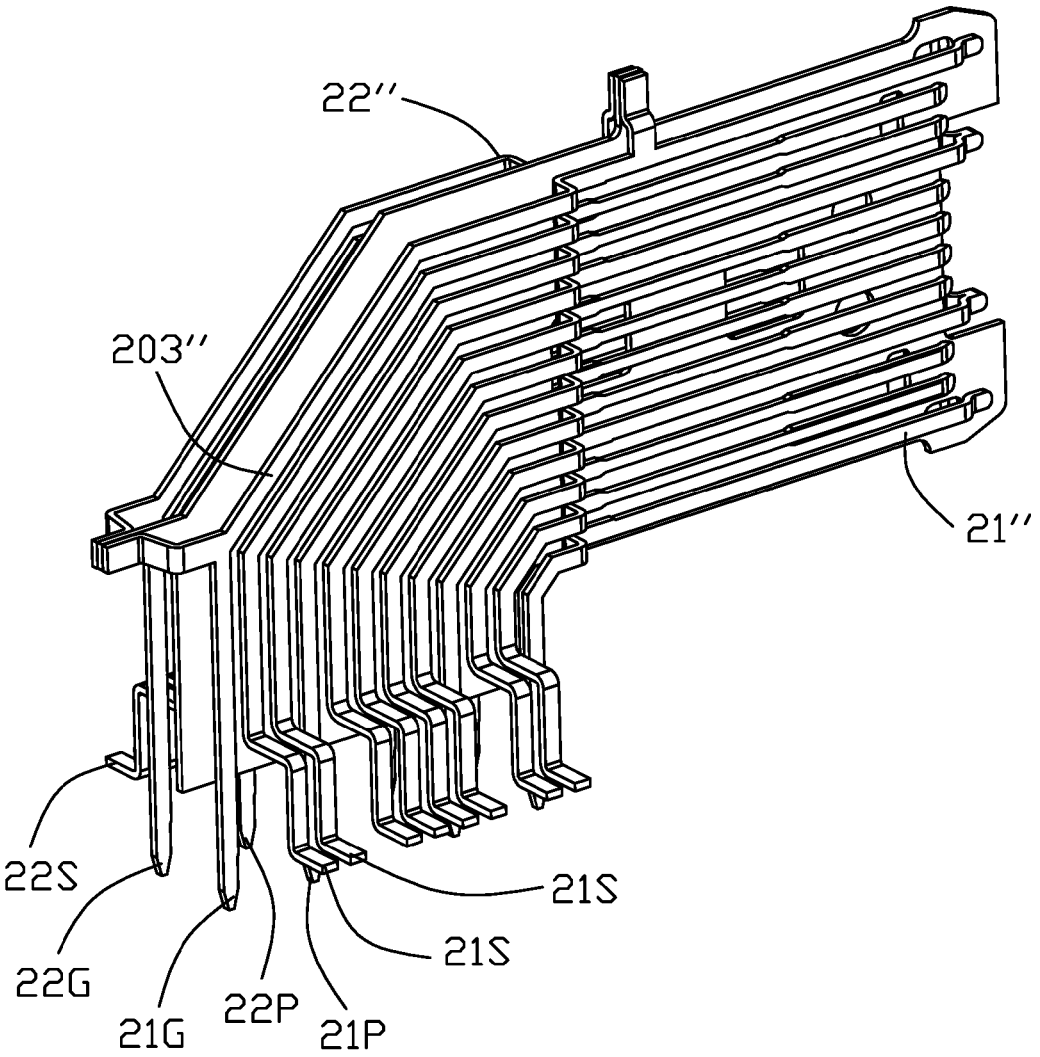
FIG. 12 is a perspective view of first terminals, second terminals and a shielding plate of the electrical connector shown in FIG. 11.
Figure 13:
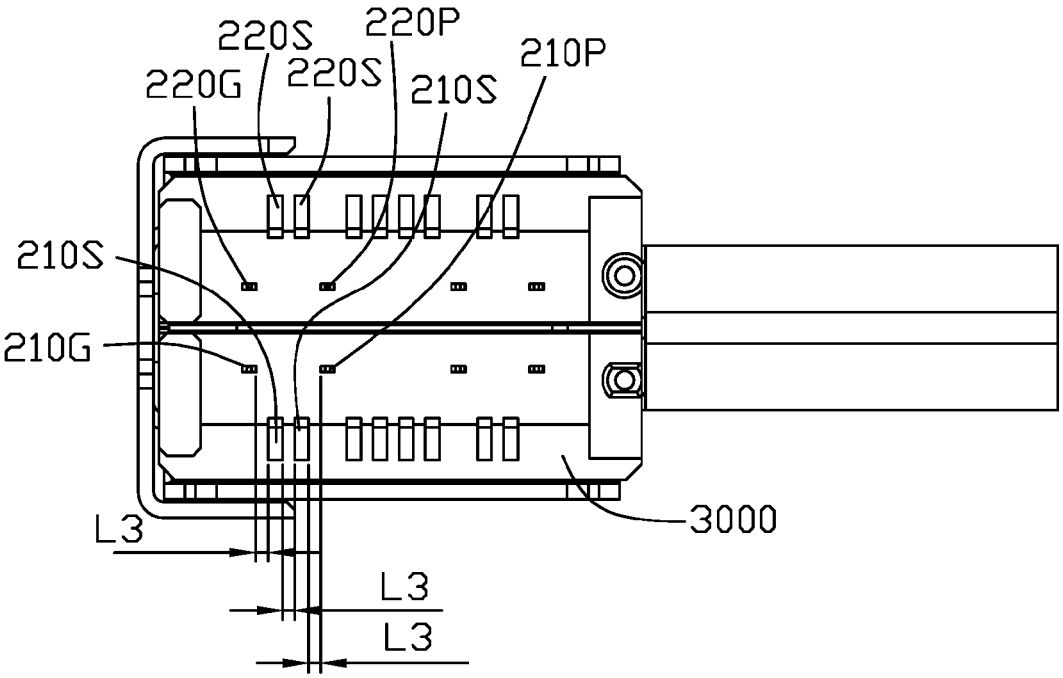
FIG. 13 is a bottom view of the electrical connector shown in FIG. 11.

Referring to FIG. 11 to FIG. 13, an electrical connector 300 of a third embodiment of the present invention is provided. The main structures of the electrical connector 300 are roughly the same as that of the electrical connector 100 of the first embodiment. The same structures will not be described in the present embodiment. The different structures will be described in detail hereinafter.

The first terminals 21" have at least a pair of signal terminals 21S, a power terminal 21P disposed at a side of the pair of the signal terminals 21S and a grounding terminal 21G disposed at the other side of the pair of the signal terminals 21S. The connecting leg 210P of the power terminal 21P and the connecting leg 210G of the grounding terminal 21G are arranged in a row in a inner side, and the connecting legs 210S of the pair of the signal terminals 21S are arranged in a different row and in an outer side relative to the connecting legs 210P, 210G of the power terminal 21P and the grounding terminal 21G. The connecting legs 210P, 210G of the power terminal 21P and the grounding terminal 21G respectively extends downwardly from the middle portions 203" of the power terminal 21P and the grounding terminal 21G, and the connecting legs 210P, 210G are configured as through hole type. The connecting legs 210S of the signal terminal 21S bends and extends outwardly from the middle portions 203" of the signal terminal 21S, and the connecting leg 210S is configured as surface mounting type. In the front to back direction, the distance L3 between the two adjacent connecting legs of first terminals 21" is equal. The sequence of the adjacent connecting legs are 210G-210S-210S-210P, it can be seen clearly in FIG. 13. The type of the second terminals 22" is the same as the type of the first terminals 21". The type of the connecting legs 220S, 220E 220P of the second terminals 22" are correspondingly the same as those of the connecting legs 210S, 210E 210P of the first terminals 21", thereby the connecting legs of the row of the second terminals 22" and the connecting legs of the row of the first terminals 21" are mirror symmetrical.

Figure 14:
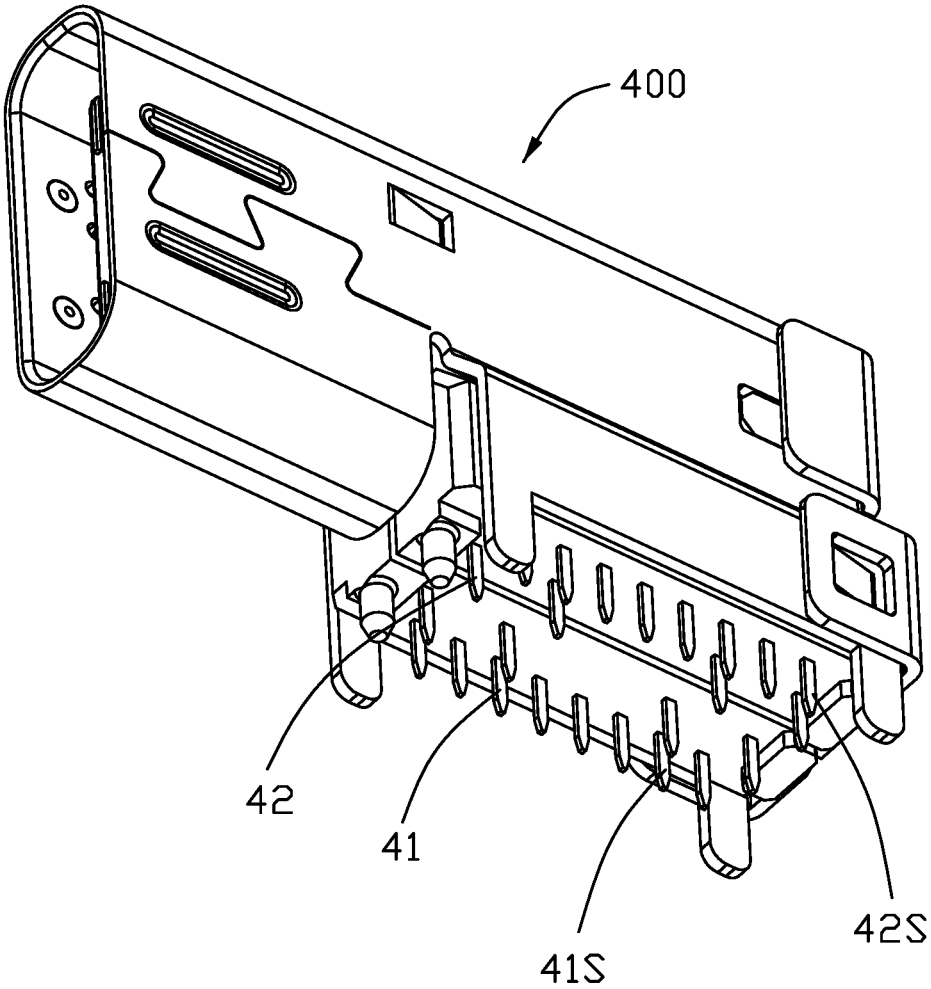
FIG. 14 is a perspective view of an electrical connector of a fourth embodiment of the present invention.
Figure 15:
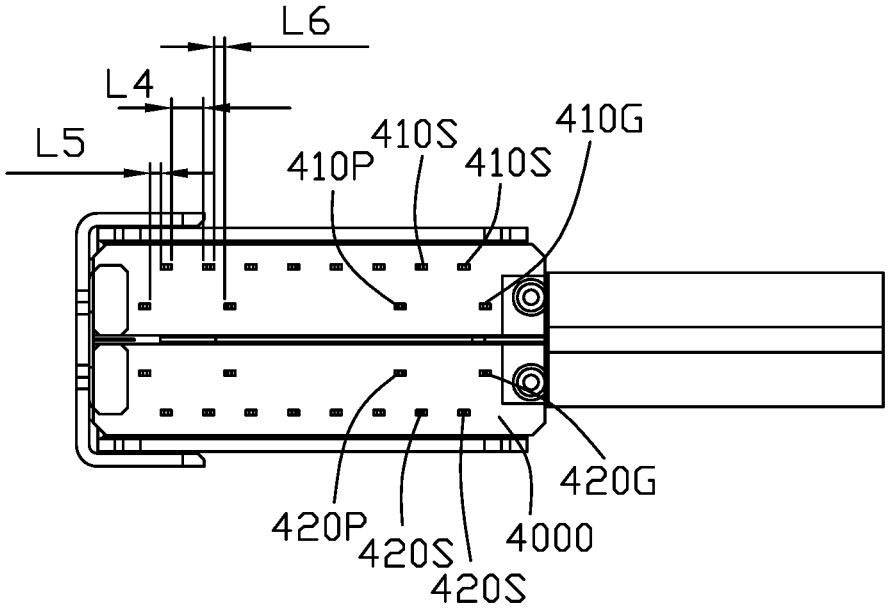
FIG. 15 is a bottom view of the electrical connector shown in FIG. 14.

Referring to FIG. 14 to FIG. 15, an electrical connector 400 of a fourth embodiment of the present invention is provided. The main structures of the electrical connector 400 are roughly the same as that of the electrical connector 300 of the third embodiment. The same structures will not be described in the present embodiment. The different structures will be described in detail hereinafter.

The difference between the present embodiment and the third embodiment is the type of the connecting legs 410S, 420S of the signal terminals 41S, 42S and the distance between the adjacent connecting legs of the terminals 41, 42. The sequence of the connecting legs of the two rows of the terminals 41, 42 are 410G-410S-410S-410P and 420G-420S-420S-420P. The connecting legs 410G, 410S, 410P of the power terminal 41P, grounding terminal 41G and the signal terminals 41S of the first terminals 41 are configured as through hole type. The connecting legs 410S of the signal terminals 41S are disposed at an outer side relative to the connecting legs 410G, 410P of the power terminal 41P and the grounding terminal 41G. In the front to back direction, the distance L4 between two adjacent connecting legs 410S of the signal terminals 41S is longer than the distance L6 between two adjacent connecting legs of the signal terminal 41S and power terminal 41P, the distance L4 between two adjacent connecting legs 410S of the signal terminals 41S is also longer than the distance L5 between two adjacent connecting legs of the signal terminal 41S and grounding terminal 41G. The type of the second terminals 42 is the same as the type of the first terminals 41. The type of the connecting legs 420S, 420G, 420P of the second terminals 42 are correspondingly the same as the type of the connecting legs 410S, 410G, 410P of the first terminals 41, thereby the connecting legs of the row of the second terminals 42 and the connecting legs of the row of the first terminals 41 are mirror symmetrical.

In the four aforementioned embodiments of the present invention, in condition of meeting the normal requirements of the soldering and high frequency transmission, the length of the products is gradually increasing as follows: the electrical connector 100 of the first embodiment, the electrical connector 300 of the third embodiment, the electrical connector 400 of the fourth embodiment, and the electrical connector 200 of the second embodiment. The area of the mounting surfaces 1000, 2000, 3000, 4000 of the electrical connectors 100, 200, 300, 400 follows the same regulation of length of the products aforementioned. In other embodiments, the connecting legs of the first terminals 21, 21', 21", 41 and the second terminals 22, 22', 22", 42 do not have to be arranged as mirror symmetrical.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulating housing having a base portion and a mating portion extending forwardly from the base portion along a front-to-back direction, the base portion having a mounting surface;

a plurality of first terminals retained in the insulating housing, the first terminals having connecting legs extending out of the mounting face, the first terminals having a pair of differential signal terminals, a power terminal, and a grounding terminal, the power terminal and the grounding terminal disposed at two opposite sides of the pair of differential signal terminals, respectively;

a plurality of second terminals retained in the insulating housing, the second terminals having connecting legs extending out of the mounting face, the second terminals having a pair of differential signal terminals, a power terminal, and a grounding terminal, the power terminal and the grounding terminal disposed at two opposite sides of the pair of differential signal terminals, respectively; and a shielding shell shielding around the insulating housing, the shielding shell surrounding the mating portion to form a mating cavity;

wherein the connecting legs of the power terminals and the grounding terminals are disposed at the middle area of the mounting surface, and the connecting legs of the differential signal terminals are respectively disposed at two opposite sides of the connecting legs of the power terminals and the grounding terminals;

wherein the first terminals have contacting portions exposed to the mating cavity and middle portions connecting the contacting portions and the connecting legs, the second terminals have contacting portions exposed to the mating cavity and middle portions connecting the contacting portions and the connecting legs, the middle portions of the first terminals bend outwardly in a transverse direction perpendicular to the front-to-back direction, the middle portions of the second terminals bend outwardly opposite to those of the first terminals in the transverse direction, and the middle portions of the first terminals are symmetrically to those of the second terminals.

2. The electrical connector as claimed in claim 1, wherein the connecting legs of the pair of differential signal terminals of the first terminals are arranged in a first row along the front-to-back direction, the connecting legs of the power terminal and the grounding terminal of the first terminals are arranged in a second row along the front-to-back direction, the connecting legs of the pair of differential signal terminals of the second terminals are arranged in a third row along the front-to-back direction, and the connecting legs of the power terminal and the grounding terminal of the second terminals are arranged in a fourth row along the front-to-back direction.

3. The electrical connector as claimed in claim 2, wherein the connecting legs are all configured as through hole type.

4. The electrical connector as claimed in claim 3, wherein a pitch between two adjacent connecting legs of the two signal terminals is larger than a pitch between the two adjacent connecting legs of the power terminal and the signal terminal in the front-to-back direction.

5. The electrical connector as claimed in claim 3, wherein a pitch between two adjacent connecting legs of the two signal terminals is larger than a pitch between the two adjacent connecting legs between the grounding terminal and the signal terminal in the front-to-back direction.

6. The electrical connector as claimed in claim 2, wherein the connecting legs of the power terminals and the grounding terminals are configured as through hole type, and the connecting legs of the two pairs of differential signal terminals are configured as surface mounting type.

7. The electrical connector as claimed in claim 6, wherein a pitch between every two adjacent connecting legs of the first terminals is same.

8. The electrical connector as claimed in claim 1, wherein the connecting legs of the first terminals and the second terminals are disposed symmetrically along the transverse direction.

9. The electrical connector as claimed in claim 1, further comprising a shielding plate embedded in the insulating housing and sandwiched between the first terminals and the second terminals, the shielding plate having two latch portions respectively exposed to two opposite sides of the mating portion.

10. The electrical connector as claimed in claim 1, wherein the middle portion has a first part connecting with and parallel to the contacting portion and a second part bending outwardly therefrom.

11. The electrical connector as claimed in claim 10, wherein the second parts of the pair of differential signal terminals have extending portions extending outwardly compare to the second parts of the power and grounding terminals.

12. A right angle type electrical connector comprising:

an insulative housing including a base portion defining a downward mounting surface in a vertical direction, and a mating portion extending forwardly from the base portion along a front-to-back direction perpendicular to said vertical direction, communicating forwardly with an exterior in said front-to-back direction, extending in a vertical plane defined by said vertical direction and said front-to-back direction, and defining two opposite first and second mating surfaces in a transverse direction perpendicular to both said vertical direction and said front-to-back direction;

a plurality of first terminals disposed in the housing and including at least a pair of first differential pair signal terminals, a first power terminal and a first grounding terminal, each of said first terminals including a first front contacting section exposed upon the first mating surface of the mating portion, a first rear mounting section exposed upon the mounting surface, and a first middle portion linked between the first front contacting section and the first rear mounting section, the first power terminal and the first grounding terminal being located by two sides of the pair of first differential pair signal terminals in a side view along said transverse direction;

a plurality of second terminals disposed in the housing and including at least a pair of second differential pair signal terminals, a second power terminal and a second grounding terminal, each of said second terminals including a second front contacting section exposed upon the second mating surface of the mating tongue, a second rear mounting section exposed upon the mounting surface, and a second middle portion linked between the second front contacting section and the second rear mounting section, the second power terminal and the second grounding terminal being located by two sides of the pair of second differential pair signal terminals in the side view along said transverse direction;

said pair of first differential pair signal terminals, said first power terminal and said first grounding terminal of said first terminals, and said pair of second differential pair signal terminals, said second power terminal and said second grounding terminal of said second terminal being symmetrical with each other along an imaginary center vertical plane of said mating portion; wherein the first front contacting sections of said pair of first differential pair signal terminals and those of the first power terminal and the first grounding terminal are located at a same vertical plane on said first mating surface while the first rear mounting sections of the first power terminal and the first grounding terminal are inwardly offset from those of said pair of first differential pair signal terminals in the transverse direction; wherein the second front contacting sections of said pair of second differential pair signal terminals and those of the second power terminal and the second grounding terminal are located at a same vertical plane on said second mating surface while the second rear mounting sections of the second power terminal and the second grounding terminal are inwardly offset from those of said pair of second differential pair signal terminals in the transverse direction; wherein the first middle portions of the first terminals are located in a vertical plane which is located between the vertical plane defined by all the first terminals and another vertical plane defined by the first rear mounting sections of said first differential pair signal terminals in the transverse direction; wherein the second middle portions of the second terminals are located in a vertical plane which is located between the vertical plane defined by all the second terminals and another vertical plane defined by the second rear mounting sections of said second differential pair signal terminals in the transverse direction.

13. The right angle type electrical connector as claimed in claim 12, further including a metallic shielding plate located between said first terminals and said second terminals in the transverse direction, wherein said shielding plate includes a front portion embedded within the mating portion and a rear portion embedded within the base portion, said rear portion terminated downwardly around the mounting surface.

14. The right angle type electrical connector as claimed in claim 13, wherein the first grounding terminal and the second grounding terminal commonly sandwich and contact a protrusion of the shielding plate.

15. The right angle type electrical connector as claimed in claim 12, wherein the first rear mounting sections of the pair of first differential pair signal terminals are of a surface mounting type while those of the first power terminal and of the first grounding terminal are of a through hole type, and the second rear mounting sections of the pair of second differential pair signal terminals are of the surface mounting type while those of the second power terminal and of the second grounding terminal are of the through hole type.

16. A vertical type electrical connector comprising:

a first terminal module and a second terminal module commonly symmetrically sandwiching a metallic shielding plate therebetween in a transverse direction, said shielding plate extending in a vertical plane defined by a front-to-back direction and a vertical direction perpendicular to each other and commonly perpendicular to said transverse direction;

the first terminal module including a first insulator with a plurality of first terminals embedded therein, the first insulator including a first base portion and a first mating portion extending from the first base portion, said first base portion forming a first bottom portion outwardly expanded in the transverse direction with a first mounting surface thereon, the first terminals including at least a pair of first differential pair signal terminals with a first power terminal and a first grounding terminal by two sides in a side view along the transverse direction, each of said first terminals including a first contacting section exposed upon the first mating portion, and a first mounting section exposed upon the first mounting surface;

the second terminal module including a second insulator with a plurality of second terminals embedded therein, the second insulator including a second base portion and a second mating portion extending from the second base portion, said second base portion forming a second bottom portion outwardly expanded in the transverse direction with a second mounting surface thereon, the second terminals including at least a pair of second differential pair signal terminals with a second power terminal and a second grounding terminal located by two sides in the side view along the transverse direction, each of said second terminals including a second contacting section exposed upon the second mating portion, and a second mounting section exposed upon the second mounting surface;

the first contacting sections being located in a same vertical plane on the first mating portion while the first mounting sections of the first power terminal and of the first grounding terminal being located inwardly offset from those of the pair of first differential pair signal terminals in said transverse direction;

the second contacting sections being located in another same vertical plane on the second mating portion while the second mounting sections of the second power terminal and of the second grounding terminal being located inwardly offset from those of the pair of second differential pair signal terminals in said transverse direction;

further including a metallic shield enclosing the first terminal module and the second terminal module, wherein said shield includes a capsular portion enclosing the first mating portion and the second mating portion, and a pair of split wings outwardly extending away from each other in the transverse direction away and covering the expanded first bottom portion and second bottom portion, respectively, wherein said pair of wings are symmetrical with each other with regard to an imaginary center plane defined by said shielding plate.

17. The right angle type electrical connector as claimed in claim 12, wherein the first rear connecting sections of the first power terminal and the first grounding terminal are located in the same vertical plane defined by the first middle portions, and the second rear connecting sections of the second power terminal and the second grounding terminal are located in the same vertical plane defined by the second middle portions.

18. The vertical type electrical connector as claimed in claim 16, wherein the capsular portion forms a mating port forwardly in communication with an exterior in the front-to-back direction.

19. The vertical type electrical connector as claimed in claim 18, wherein said shield is terminated around the first mounting surface and said second mounting surface in the vertical direction.

* * * * *